US006838988B2

(12) United States Patent
Lennartz et al.

(10) Patent No.: US 6,838,988 B2
(45) Date of Patent: Jan. 4, 2005

(54) SMOKE DETECTOR WITH PERFORMANCE REPORTING

(75) Inventors: Gary Lennartz, Hillsburgh (CA); Scott Singleton, Woodville (CA)

(73) Assignee: Digital Security Controls Ltd., Concord (CA)

( * ) Notice: Subject to any disclaimer, the term of this patent is extended or adjusted under 35 U.S.C. 154(b) by 27 days.

(21) Appl. No.: 10/603,779

(22) Filed: Jun. 26, 2003

(65) Prior Publication Data

US 2004/0217857 A1 Nov. 4, 2004

(51) Int. Cl.[7] ..... G08B 1/08

(52) U.S. Cl. ..... 340/539.26; 340/514; 340/539.1; 340/628; 340/632

(58) Field of Search ..... 340/539.26, 628, 340/630, 632, 514, 515, 540, 539.1, 534; 73/1.06, 23.2

(56) References Cited

U.S. PATENT DOCUMENTS 4,827,244 A 5/1989 Bellavia et al.
5,670,946 A * 9/1997 Ellwood et al. ..... 340/628
5,691,699 A 11/1997 Vane et al.
6,133,839 A * 10/2000 Ellul et al. ..... 340/584
6,323,780 B1 * 11/2001 Morris ..... 340/692
6,380,854 B1 * 4/2002 Hagerman et al. ..... 340/540
6,423,962 B1 * 7/2002 Pepper ..... 340/630
6,522,248 B1 * 2/2003 Andres et al. ..... 340/521

* cited by examiner

*Primary Examiner*—Davetta W. Goins
(74) *Attorney, Agent, or Firm*—Dennison Associates

(57) ABSTRACT

A cost effective system for testing smoke detectors and determining and communicating the operating characteristics thereof, advantageously uses existing circuitry components in a secondary communication function. With this arrangement, a low powered RF reporting signal is transmitted from the smoke detector and can be received within several feet of the detector. Preferably the RF signal is produced by a pulsed input signal provided to an existing coil which is part of the circuitry used to produce and/or report alarm signals. A receiving arrangement is also disclosed which can be located in close proximity to a smoke detector which has been activated to report the operating characteristics thereof. These characteristics can then be analyzed to determine whether preventive maintenance is appropriate.

20 Claims, 3 Drawing Sheets

Smoke Alarm System Block Diagram

Figure 1: Smoke Alarm System Block Diagram

Figure 2: Smoke Alarm and Handheld Tester Block Diagram

SMOKE DETECTOR WITH PERFORMANCE REPORTING

FIELD OF THE INVENTION

The present invention relates to alarm systems and smoke detectors used in alarm systems and in particular, relates to downloading of performance information from such smoke detectors.

BACKGROUND OF THE INVENTION

Alarm systems are used by consumer and industrial users to provide improved safety and security of residences and industrial facilities. These alarm systems typically include an alarm panel which receives and monitors signals from a host of peripheral devices, including keypads, various sensors and warning devices. The control panels, upon receiving notice of an alarm condition typically report to a remote central station over a telephone line or other communication path.

Alarm systems can be divided into hard wire systems where the alarm panel is hard wired to the various peripheral devices such as smoke detectors, motion detectors, etc., or a wireless system where these devices communicate with the alarm panel using RF transmissions, for example. In wireless systems, each of the peripheral devices have their own battery power source and the number and type of transmissions are managed to conserve power while providing positive communication. There are also alarm systems which use a combination of hard wired and RF peripheral devices.

Each alarm system typically has a number of sensors which report to the alarm panel. Updating of systems or extending of the systems can include the addition of more current sensors and/or the replacement of certain sensors with more current sensors. It is also possible to update or replace the alarm panel, however, in many cases, this is not practical from a cost standpoint as the entire alarm system is typically replaced.

Certain detectors tend to require more service than others. In particular, smoke detectors do deteriorate with age and also can have widely changing performance characteristics with the particular environment. Dust accumulation within the sensing chamber of the smoke detector can seriously affect the performance characteristics of the detector. Many smoke detectors include their own performance monitoring function to provide an early indication of deterioration. This early warning avoids false alarms which are expensive and also reduce the reliability of the system. Unfortunately, the performance monitoring of the smoke detectors includes data which is not reported to the alarm control panel as at the time of manufacture of the alarm control panel, this type of data may not have been available or that the detectors did not report this type of data to the alarm control panel. This situation is compounded in that new detectors which may be added to a system cannot report this information to an old style alarm panel and it is difficult to justify replacement of the alarm control panel.

In addition, although the reporting of the performance characteristics of smoke detectors is important in an alarm system, there are many motion sensors, sound sensors, etc. which continue to operate in a satisfactory manner and do not require the type of service or monitoring associated with smoke detectors.

U.S. Pat. No. 5,691,699 discloses a security detector which allows for data output by pulsing of a light emitting diode. The separate outputting of performance data of a smoke detector allows this data to be received and analyzed, however, a substantial cost of the detector has increased.

It is known to service an alarm system by testing of the various devices including smoke detectors and to also gather information from these detectors as part of this service step. Certain smoke detectors include their own output port which can be physically connected to a portable device for downloading information to the portable device when the smoke detector is appropriately activated by the user. It is also know to produce smoke detectors which have their own wireless receiving arrangement for communication with a portable device such as a flashlight. One such arrangement is shown in U.S. Pat. No. 4,827,244. In this case, a smoke detector includes its own light sensor which acts as a receiver and allows for activation of the device in a test mode or to alter the alarm signal thereof.

The industry has recognized the value of monitoring the performance characteristics of smoke detectors, and the value of transmitting the assessment of the performance of the smoke detector to an alarm control panel, or to a portable device, however, another driving force in the industry is a system which is inexpensive to manufacture and maintain. The additional cost for providing a smoke detector with its own RF transmitter and/or other data output device, does improve the monitoring function of the device, however, there is a substantial cost penalty which renders the system less competitive.

Furthermore, it can be appreciated that such an arrangement is more convenient for wireless smoke detectors, yet there are many systems which include both wired and wireless smoke detectors. Monitoring of only some of the smoke detectors is not a complete solution.

In order to reduce false alarms and to provide preventative maintenance, service contractors test alarm systems on a regular basis. It would be desirable to provide a check on the preventative maintenance carried out and a record of the results for longer term trends.

There remains a need for a simple cost effective solution for monitoring and evaluating the performance of smoke detectors.

SUMMARY OF THE INVENTION

A smoke detector according to the present invention comprises a smoke detecting chamber, an operating circuit for sensing smoke particles in the chamber and producing an alarm signal based on the sensed smoke particles. The smoke detector has electrical circuitry, including a coil, used when an alarm signal is produced, an input receiver for initiating a test in response to a test signal being received, an evaluation arrangement for determining operating characteristics of the operating circuit which vary over times and a controller for reporting the determined operating characteristics of the smoke detector in response to a test signal being received. The controller codes a pulsed signal with said determined operating characteristics and uses the coded pulsed signal to drive said electrical coil. The coded pulsed signal causes the electrical coil to produce a coded low power RF signal which includes the determined operating characteristics. The coded RF signal is receivable within a short distance of the smoke detector.

In an aspect of the invention, the smoke detector includes a sound generator used to indicate a sensed alarm condition, said sound generator having a coil associated with a drive circuit for said sound generator, and the electrical coil is part of electrical circuitry of the sound generator.

In a further aspect of the invention, the electrical coil is part of a relay which is activated to produce an alarm signal.

In the present invention, the cost to produce the coded RF signal is low as the transmitting coil or components necessary for a different function, are already present, and used in as part of the secondary function.

A smoke detector according to a preferred aspect of the invention comprises a smoke detecting chamber, an arrangement for sensing smoke particles in the chamber, an evaluation arrangement for evaluating the operating characteristics of the arrangement for sensing smoke particles, and transmitting a coded signal in a weak RF signal in response to a test signal being received by the detector. The smoke detector has a sound generator used to indicate a sensed alarm condition. The sound generator has a drive circuit associated therewith which amplifies a pulsed signal to provide a drive signal for the sound generator. The smoke detector includes a controller for reporting status information of the smoke detector in response to a user activating the test actuator. The controller codes the pulse signal used to generate the drive signal. This coding is done with the status information of the smoke detector. The coded pulse signal causes the drive circuit to produce a low power RF signal which includes the coded status information. The coded RF signal is capable of being accurately received within a short distance of the smoke detector. In a preferred embodiment the signal is designed to be received by a portable receiver within approximately a two foot radius of the smoke detector.

According to a further aspect of the invention, a smoke detector has a coil as part of the drive circuit. The coil is necessary for altering the power characteristics of the signal for driving of the sound generator. This coil inherently produces a low power RF signal when the coded pulse signal is used by the drive circuit to produce a drive signal.

According to yet a further aspect of the invention, a test actuator is a switch accessible on the face of the smoke detector.

In yet a further aspect of the invention, the status information of the smoke detector includes information specific to the calibration information of the smoke detector.

In yet a further aspect of the invention, the status information includes operating data information of the smoke detector.

In yet a further aspect of the invention, the smoke detector is a hard wired detector and includes means for reporting alarm conditions to a control panel over a wired network.

An alarm system, according to the present invention, comprises a plurality of smoke detectors which report alarm conditions to a central controller for processing. Each smoke detector includes a test actuator, a self evaluation arrangement for producing an assessment of the operating characteristics of the detector, and reporting of the operating characteristics in response to the activation of the test actuator. A transmitting arrangement is provided with each smoke detector for transmitting an RF signal in response to activation of the test actuator. The RF signal includes the assessment of the operating characteristics of the smoke detector. Each smoke detector includes a sound generator which is activated upon detection of an alarm condition and in response to actuation of the test actuator. The sound generator has a power circuit associated therewith which produces a drive signal used to power the sound generator. The power circuit receives the assessment of the operating characteristics of the smoke detector and incorporates the operating characteristics in an input signal used by the power circuit to produce the drive signal. The power circuit in the production of the drive signal transmits the RF signal. The system further includes a portable assessment receiver which when placed in close proximity to any of the smoke detectors which have been activated, receives the RF signal and records the assessment of the particular signal in association with the identify of the particular smoke detector for future reference.

According to yet a further aspect of the invention, the power circuit includes a voltage transformer used to increase the voltage of the input signal and wherein the transformer inherently produces the RF signal when driven with the input signal.

According to yet a further aspect of the invention, the RF signal is a weak RF signal received by the portable assessment receiver within approximately three feet of the transmitting smoke detector.

According to yet a further aspect of the invention, at least some of the smoke detectors are hard wired to the central controller.

In yet a further aspect of the invention, some of said smoke detectors communicate with the central controller using their own separate RF transmitter and which transmit the operating characteristics using the separate RF transmitter in response to actuation of the test actuator.

In yet a further aspect of the invention, the portable assessment receiver cooperates with a separate computer which receives and stores the operating characteristics of the smoke detectors stored in the portable assessment receiver.

In yet a further aspect of the invention, a separate computer contains a log of the operating characteristics of each smoke detector and assesses changes in the operating characteristics for possible preventative service of smoke detectors where changes in the operating characteristics are indicative of potential inadequate performance.

In yet a further aspect of the invention, the separate computer analyzes the operating characteristics for possible conditions which can be rectified by cleaning of the smoke detectors.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
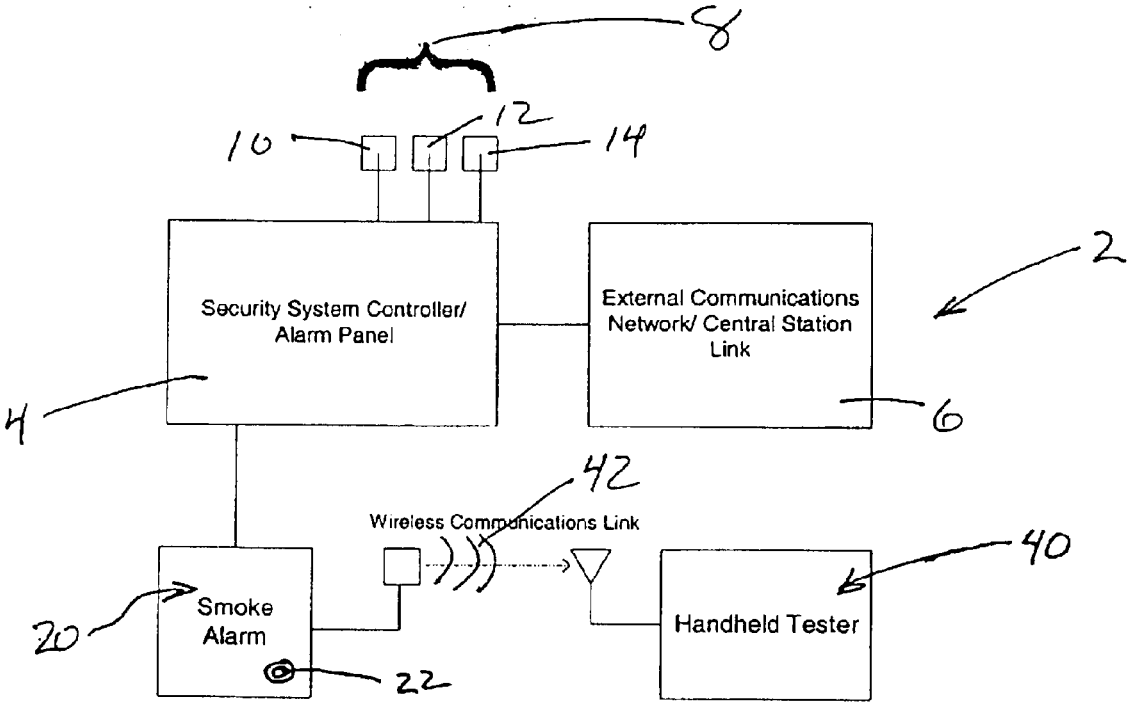
FIG. 1 is a block diagram of an alarm system having the particular cooperation between a smoke detector and a hand held tester.

The alarm system 2 as shown in FIG. 1, includes an alarm panel 4 which basically receives and processes signals from the various peripheral devices 8, including sensors 10, key pads 12 and sounders 14. The alarm panel 4 also cooperates with an external communication network generally shown as 6 for communicating with a central station. This central station processes the various signals from alarm panels and undertakes appropriate action such as alerting of police or other emergency or response services.

Alarm systems of this general type have been known for many years and are extremely popular for home and business applications.

Smoke detectors used in association with this type of alarm system, are subject to decreasing performance due to age and decreasing performance due to environmental contaminations such as dust, etc. Smoke detectors, if not properly serviced, can cause false alarms or require immediate attention at inconvenient times. For this reason, it is known to test alarm systems and in particular, test smoke alarm detectors on a scheduled basis. To assist in this type of routine inspection and evaluation, smoke detectors, in addition to reporting alarm conditions to the alarm panel 4, can report performance evaluation characteristics, either to the alarm panel or to a separate device.

The smoke detector 20 includes its own switch or test actuator 22 provided on an outside surface of the housing of the smoke detector. Actuation of the test actuator causes the smoke detector to undergo its own test evaluation and to initiate its sound generator. The performance evaluation characteristics are included in a signal and are transmitted as a weak RF signal 42 to a hand held tester generally shown as 40. This hand held tester would be in close proximity to the smoke detector 20 for receiving of the weak RD signal 42. Typically the hand held tester 40 would be placed within three feet and preferably, within one to two feet of the smoke detector.

Figure 2:
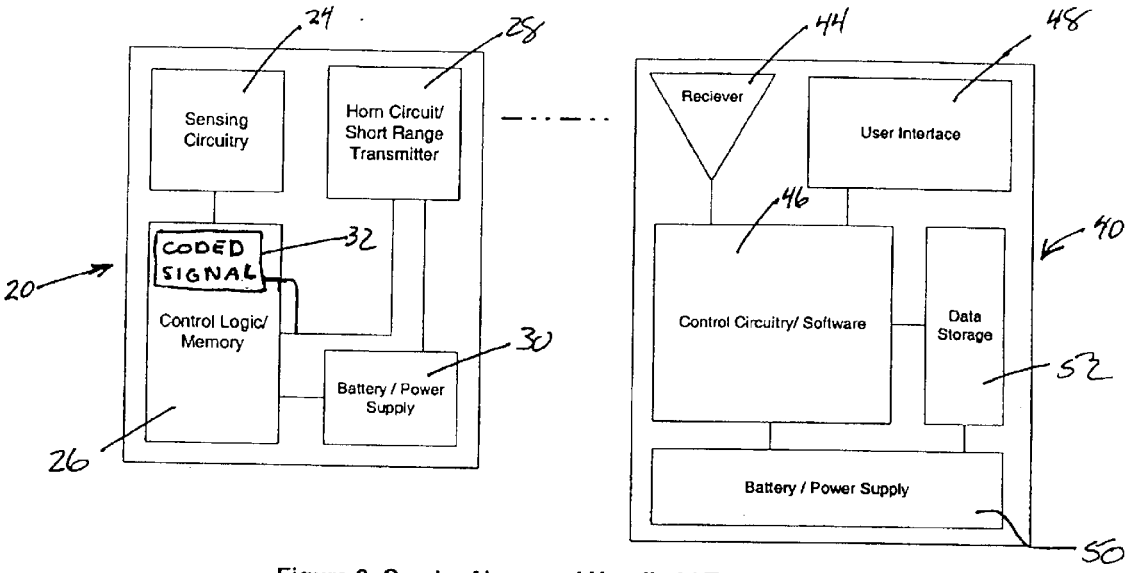
FIG. 2 is a schematic of the smoke detector and hand held detector.
Figure 3:
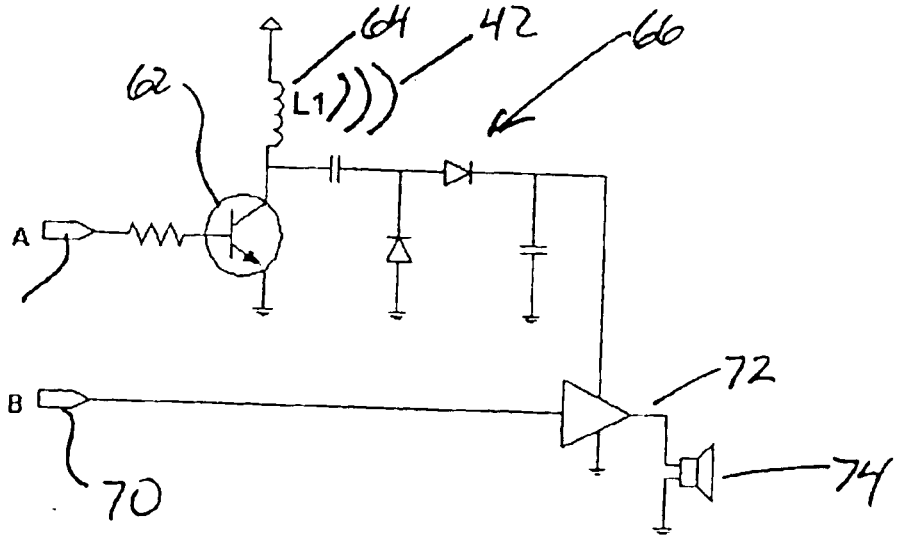
FIG. 3 is a circuit diagram of the power circuit used to power the sound generator.

The weak RF signal is advantageously produced in a cost effective manner as will be more fully described with respect to FIGS. 2 and 3.

The block diagram of the smoke detector hand held tester is shown in FIG. 2. The smoke detector 20 has control logic and memory 26, sensing circuitry 24, a horn circuit, a short range transmitter 28, and a battery power supply 30. The control logic 26 includes an evaluation capability of the sensing circuitry 24. This includes performance characteristics of the smoke detector, the battery level of the battery 30 and other information which is valuable in assessing the smoke detector 20. These characteristics are coded in the coded signal indicated as 32 and associated with the horn circuit 28.

The hand held tester 40 includes an RF receiver 44, control circuitry software 46, a user interface 48, a battery power supply 50, and data storage 52. Data storage 52 is used to receive the serial number of the smoke detector and the performance evaluation characteristics thereof which are all part of the coded signal 32. As previously described, the receiver 44, when placed in close proximity to the smoke detector 20, can receive an RF signal from the smoke detector which includes the coded signal 32.

FIG. 3 shows a basic switch mode power supply circuit for the horn driver of the smoke detector. The pulse coded signal is introduced at 60 and is used for turning on and off the transistor 62. This produces a pulsed current through the inductor 64 resulting in a weak RF signal 42 having the characteristics of the pulsed coded signal introduced at 60. In addition to producing the weak RF signal 42, the remaining circuit components, indicated as 66, rectify and filter the signal to power the circuit that amplifies the signal introduced at "B". This arrangement results in a signal at 72 which powers the sound generator 74. The components 66, together with the coil 64, are required for producing of the drive signal 72 for the sound generator 74. The pulse coded signal introduced at "A" which is basically transmitted in the weak RF signal 42, advantageously uses the components of the drive circuit for the sound generator to inherently produce the RF signal.

Thus, the only additional component that is required in the smoke detector to produce the weak RF signal is the additional logic required to determine the coded signal 32 and some software for modifying the operation of the smoke detector. Smoke detectors require this type of circuitry for the production of the drive signal to achieve the required sound level over a wide range of input voltages. It can be appreciated that the power supply of the smoke detector is reducing overtime and must operate over a wide voltage range.

When a test mode is activated on smoke detector 20, for example, by pressing actuator 22, the detector introduces the coded signal 32 at 60 in FIG. 3, this results in pulses at coil 64, with this coil radiating a weak electromagnetic field. When the test meter 40 is in close proximity to the smoke detector 20, this weak RF signal is received by receiver 44, is processed by the control circuitry and software 46, and results in the information being stored in the data storage 52 together with the identity of the smoke detector. This identity of the smoke detector can be buried in the signal transmitted by the smoke detector and it can also be associated with various information entered by the test personnel, using the user interface 48. This could include test dates, the test personnel code and other information.

In many hardwired smoke alarm systems, a relay is used to initiate communication with the central controller and particularly, to report an alarm condition. The relay includes a coil which can be pulsed to produce electromagnetic pulses. If the pulses are of a short duration, the relay will not be activated but a weak RF signal is produced. This arrangement allows the relay to be used as a transmitter in addition to its normal function in producing an alarm signal. Thus, the ability to communicate operating characteristics in response to a test input is provided with little additional cost.

Figure 4:
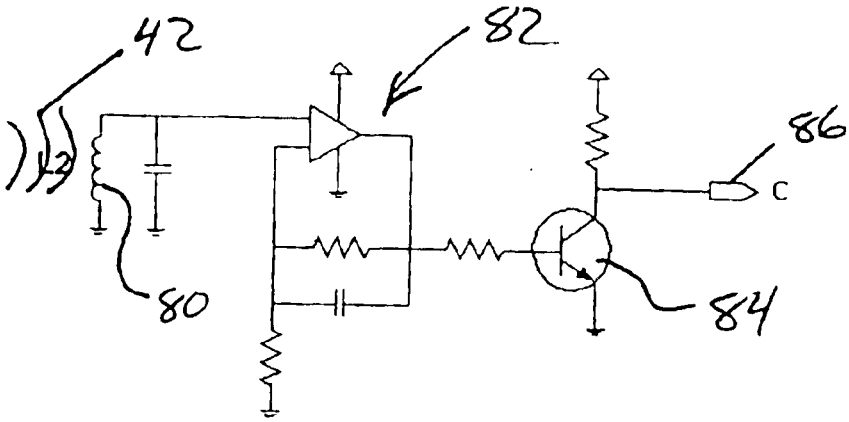
FIG. 4 is a circuit diagram showing the electrical components of the test evaluation device.

The handheld tester and/or the smoke detector 20 can include a preliminary indication of a possible service condition or the information can be downloaded from the hand held tester of FIG. 2 and FIG. 4 to a separate computer which then analyzes the information and makes recommendations with respect to service.

Turning to FIG. 4, it can be seen that the hand held tester includes its own coil 80 for receiving the weak RF transmissions 42. The signal from the coil 80 is appropriately processed by the operational amplifier in the band pass configuration shown as 82 and is used as the control signal for the transistor 84. This arrangement amplifies the resulting pulsed signal and produces a digital output signal at 86.

As can be appreciated from the above, the actual smoke detector uses the existing drive circuit component for the sound generator to additionally or inherently produce a weak RF signal which has been coded with XXXXX. As can be appreciated, the smoke detector 20 has been modified with very little additional cost to produce a weak RF performance signal in response to a test actuator being activated. Typically, smoke detectors include such a test actuator for conducting an evaluation and providing an indication the smoke detector is within an acceptable operating range. With the present system, this test which still results in this type of information, also results in a weak RF signal which includes specific performance characteristics of the smoke. Such a weak RF signal can be received by a hand held test unit placed in a close proximity to the smoke detector. Very little cost has been added to the smoke detector while providing a system that allows more accurate recording of the performing characteristics of the smoke detector and also allows for the owner to maintain information over time and make predictions with respect to the service requirements of the smoke detector.

This type of transmission in a weak RF signal, can be used for both wireless smoke detectors which transmit RF signals as well as hard wired smoke detectors which normally communicate over hard wires to the alarm panel. For wireless smoke detectors, these performance characteristics can be part of a RF transmission using the RF transmitter or it can be produced in the manner of modifying the drive circuit as previously described to produce the weak RF signal. Hard wired smoke detectors can produce the weak RF signal in the manner specifically described. With this system, there is no requirement to replace the alarm panel and procedures for testing of the overall system can include the accumulation of the operational state of the smoke detectors.

The hand held unit 40 preferably has its own display for displaying the information to allow the installer or maintenance person to conduct an initial review of the device while also maintaining this information in the storage arrangement for later downloading to a central computer. The hand held device will add a log number to the data information and will record the serial number of the smoke detector that is imbedded in the signal and can record other conditions such as ambient temperatures and dates, etc. With this arrangement, the host of smoke detectors can be tested and the specific information of these smoke detectors gathered in the hand held device. Typically, the hand held tester can store up to several hundred test results. This arrangement also acts as a cross check that the installer has performed the necessary maintenance test.

Any tests which indicate cleaning can be reported after the cleaning has been completed as a further confirmation that the required service has been completed.

The data, when downloaded to a central computer or other device, will provide a maintenance record for all of the particular smoke detectors, this database can be analyzed for changes and various alarm reports or maintenance reports can be produced.

With this arrangement, smoke detectors which can have a useful life of up to ten years, can be inspected and predictions with respect to preventative maintenance can be made. Dust can increase the sensitivity of the smoke detector, as dusk reflects the light within the smoke evaluation chamber. This results in the sensed signal increasing and the smoke detector becoming more sensitive. Unfortunately, this sensitivity is not necessarily reflective of the sensed property, i.e. smoke particles. In addition, the battery level is also a factor which affects the light output used to sense smoke particles and with decreasing voltage, the amount of light produced is reduced. Furthermore, the light emitting diode can also deteriorate over time.

In hard wired systems, voltage on the power lines can be tested for proper levels. Occasionally, such hard wired systems can have breaks or increases in resistance in the wires connecting the smoke detector to the alarm panel.

Smoke detectors typically include a compensation adjustment to take into account individual changes in the smoke detector. This compensation level is essentially a base signal which is subtracted from the detectors' signal for determining whether an alarm condition is present. This level of compensation which is determined and adjusted by the smoke detector also provides the service technician with information used to determine whether cleaning, service or replacement of the smoke detector is recommended.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A smoke detector comprising a smoke detecting chamber, an operating circuit for sensing smoke particles in said chamber and producing an alarm signal when based on the sensed smoke particles; said smoke detector having electrical circuitry, including a coil, used when an alarm signal is produced; an input receiver for initiating a test in response to a test signal being received; an evaluation arrangement for determining operating characteristics of said operating circuit which vary over time; a controller for reporting the determined operating characteristics of said smoke detector in response to a test signal being received, said controller coding a pulsed signal with said determined operating characteristics and using said coded pulsed signal to drive said electrical coil, said coded pulsed signal causing said electrical coil to produce a coded low power RF signal which includes said determined operating characteristics, said coded RF signal being receivable within a short distance of said smoke detector.

2. A smoke detector as claimed in claim 1 wherein said smoke detector includes a sound generator used to indicate a sensed alarm condition, said sound generator having a coil associated with a drive circuit for said sound generator, and said electrical coil is part of electrical circuitry of said sound generator.

3. A smoke detector as claimed in claim 2 wherein said input receiver is a switch accessible on a face of said smoke detector.

4. A smoke detector as claimed in claim 1 wherein said electrical coil is part of a relay which is activated to produce an alarm signal.

5. A smoke detector as claimed in claim 1 wherein said coded pulsed signal additionally includes operating data information of said smoke detector.

6. A smoke detector as claimed in claim 1 wherein said smoke detector is a hardwired smoke detector including means for reporting alarm conditions to a control panel over a wired network.

7. A smoke detector comprising a smoke detecting chamber, arrangement for sensing smoke particles in said chamber, an evaluation arrangement for evaluating the operating characteristics of said arrangement for sensing smoke particles and transmitting a coded signal in a weak RF signal in response to a test signal being received by said detector, said smoke detector having a sound generator used to indicate a sensed alarm condition, said sound generator having a drive circuit associated therewith which amplifies a pulsed signal to provide a drive signal for said sound generator, a controller for reporting status information of said smoke detector in response to a user activating a test actuator, said controller coding said pulsed signal used to generate said drive signal with said status information, said coded pulsed signal causing said drive circuit to produce a low power RF signal which includes said coded status information, said coded RF signal being accurately received within a short distance of said smoke detector.

8. A smoke detector as claimed in claim 7 wherein drive circuit includes a coil necessary for producing said drive signal that inherently produces said low power RF signal when said coded pulsed signal is used by said drive circuit to produce said drive signal.

9. A smoke detector as claimed in claim 8 wherein said test actuator is a switch accessible on a face of said smoke detector.

10. A smoke detector as claimed in claim 7 wherein said status information includes information specific to current calibration information of said smoke detector.

11. A smoke detector as claimed in claim 10 wherein said status information includes operating data information of said smoke detector.

12. An alarm system comprising a plurality of smoke detectors which produce an alarm signal based on sensed conditions and reports alarm conditions to a central controller for processing; each smoke detector including a test actuator, a self evaluation arrangement for producing an assessment of the operating characteristics of the detector and reporting of said operating characteristics in response to the activation of said test actuator, and a transmitting arrangement for transmitting an RF signal in response to activation of said test actuator, said RF signal including said assessment of the operating characteristics of said smoke detector, each smoke detector including electrical circuitry used to produce said alarm signal; said electrical circuitry including at least one component which additionally is used by said transmitting arrangement to transmit said RF signal; each detector including a transmitting arrangement receiving said assessment of the operating characteristics in an input signal and uses said input signal to produce said RF signal; said system further including a portable assessment receiver, said portable assessment receiver when placed in close proximity to any activated smoke detector receives said RF signal and records said assessment of the particular signal in association with the identity of the particular smoke detector for future reference.

13. An alarm system as claimed in claim 12 wherein said electrical circuitry includes a voltage transformer used to increase the voltage of said input signal and wherein said transformer inherently produces said RF signal.

14. An alarm system as claimed in claim 13 wherein said RF signal is a weak RF signal receivable by said portable assessment receiver with approximately three feet of a transmitting smoke detector.

15. An alarm system as claimed in claim 12 wherein at least some of said smoke detectors are hardwired to said central controller.

16. An alarm system as claimed in claim 14 wherein some of said smoke detectors each communicate with said central controller using a separate RF transmitter associated therewith and which transmit said operating characteristics using said separate RF transmitter in response to actuation of said test actuator.

17. An alarm system as claimed in claim 12 wherein said portable assessment receiver includes a memory storage arrangement for retaining in memory the operating characteristics of at least several hundred smoke detectors.

18. An alarm system as claimed in claim 17 wherein said portable assessment receiver cooperates with a separate computer programmed to receive and retain the operating characteristics of smoke detectors stored in said portable assessment receiver.

19. An alarm system as claimed in claim 18 wherein said separate computer retains a log of the operating characteristics of each smoke detector and assesses changes in the operating characteristics for possible preventive service of smoke detectors where changes in the operating characteristics are indicative of potential inadequate performance of any of said smoke detectors.

20. An alarm system as claimed in claim 19 wherein said separate computer analyses said operating characteristics for possible conditions which can be rectified by cleaning of the smoke detectors.

* * * * *